United States Patent [19]

Hoehne

[11] Patent Number: 4,745,780

[45] Date of Patent: May 24, 1988

[54] ELECTROMAGNETICALLY OPERATED JACQUARD ARRANGEMENT

[75] Inventor: Hans-Juergen Hoehne, Hainburg, Fed. Rep. of Germany

[73] Assignee: Karl Meyer Textilmaschinenfabrik GmbH, Fed. Rep. of Germany

[21] Appl. No.: 55,419

[22] Filed: May 28, 1987

[30] Foreign Application Priority Data

Jun. 6, 1986 [DE] Fed. Rep. of Germany ..... 3619121

[51] Int. Cl.[4] ..... D04B 23/04

[52] U.S. Cl. ..... 66/205

[58] Field of Search ..... 66/205, 204, 203, 207, 66/214

[56] References Cited

U.S. PATENT DOCUMENTS

| | | | |
|---|---|---|---|
| 4,285,217 | 8/1981 | Mista et al. | 66/205 |
| 4,448,046 | 5/1984 | Mista et al. | 66/205 |
| 4,590,776 | 5/1986 | Bonasehi | 66/205 |

*Primary Examiner*—Ronald Feldbaum

*Attorney, Agent, or Firm*—Omri M. Behr

[57] ABSTRACT

There is provided an electromagnetically operated jacquard control arrangement having a magnetic system. Each control element is provided with a magnetic core having a corresponding repulsion winding and a anchor equipped with a permanent magnet. A control arm urges the anchor toward the magnetic core on each cycle. When the repulsion winding is activated the anchor is repelled from the magnetic core. If there is no activation, then the anchor remains in its position. A control arrangement of this type works in a highly reliable manner.

20 Claims, 2 Drawing Sheets

ELECTROMAGNETICALLY OPERATED JACQUARD ARRANGEMENT

BACKGROUND OF THE INVENTION

The present invention concerns an electromagnetically operated jacquard steering arrangement wherein each steerable element has a magnetic system comprising a magnetic core, an anchor and a permanent magnet in which a repulsion winding is placed around the core. Each element is further provided with a coupling arm.

In a known arrangement of this type (DE-AS No. 2235225) permanent magnets are made part of the magnetic core which carries the repulsion winding. A plurality of anchors are moved towards their corresponding magnets and subsequently are returned to their starting position.

If, during this cycle the repulsion winding is not activated, the anchor is held by the magnet core. If, by operation of the repulsion winding, on the other hand, the magnetic field of the permanent magnet is neutralized, the anchor remains in its original position. The anchors operate upon intermediary elements whose position determines whether the steerable elements are displaced by a drive arrangement during a particular cycle or not.

In this known case, because the permanent magnet is located at the magnetic core it is necessary to set the repulsion current rather exactly. If that current is too small, the anchor is attracted because of the excess strength of the permanent magnet field. On the other hand, if it was too large, the anchor was pulled towards the core because of the excess strength of the electromagnetic field.

Permanent magnets are, unfortunately, sensitive to physical impact. Such impact either substantially reduces the magnetization or else the magnetic materials such as ferite ceramic, is fragile and mechanically sensitive. If one merely moves the anchor, one is then certain that in the contact phase, only the mass of the anchor and the portions connected thereto will play any part in the impact. On the other hand, if the battery of magnetic cores was moved towards the anchors, because it is impossible to control the impact time of all anchors with absolute accuracy, certain anchors will absorb a much higher impact energy than others.

There is further provided a jacquard steering arrangement in U.S. Pat. No. 4,448,046, (the disclosure of which is incorporated herein by reference) in which the retention of the anchor by the magnetic core is not caused by a permanent magnet but rather by the activation of an attraction winding which must be maintained active as long as the anchor is to be held fast to the magnetic core. In this construction, the magnetic core is fixedly located while the anchor is rotatable about an axis. The magnetic core is combined with a coupling arm which, by rotary displacement, acts positively upon a harness cord or the like. A lever arm which may be cyclically activated, presses the anchor against the magnet core.

SUMMARY OF THE INVENTION

In accordance with the illustrative embodiment demonstrating features and advantages of the present invention, there is provided a magnetic system in an electromagnetically activated jacquard steering arrangement. This jacquard arrangement is used for positioning a plurality of steerable elements. The magnetic system includes a magnetic core and an anchor. The magnetic core and anchor are relatively reciprocatable with respect to each other. A permanent magnet is attached to the anchor. The magnetic system also has a repulsion winding on the magnetic core. Also included is a setting means which is coupled to one of the steerable elements. The setting means is operable after the magnetic core and the anchor are caused to approach each other to position the steerable element into one of two working positions, in response to activation or deactivation of the repulsion winding, respectively.

The purpose of the present invention is to provide a jacquard arrangement of the foregoing type which is substantially immune to disturbances due to power failure.

This particular problem is solved in that the permanent magnet is attached to the anchor itself.

In this construction, it is possible to avoid the need for safety arrangements for avoiding a condition where the repulsion magnetic field and the permanent magnetic field are of dissimilar strength, for example, when repulsion current is altered because of potential changes in the power supply.

By utilizing magnetic repulsion, it is possible to either avoid the need for resetting springs or it is possible to be content with substantially weaker resetting springs than was possible heretofore.

It has been found especially desirable to keep the magnetic core stationary and permit only the anchor with a permanent magnet thereon to move. It has further been found advantageous to mount the anchor in a rotatable position connected to a coupling arm and move it against the magnetic core by means of cyclically activatable lever arm. This gives rise to a substantial reduction in the momentum of the anchor. Furthermore, such an arrangement is easier to build so that it is possible to substantially avoid failures due to assembly maladjustments.

In a preferred embodiment of the arrangement, there is provided a repulsion current switch arrangement which, in accordance with desired pattern, provides overlapping current impulses at the beginning of the return movement of the coupling arm.

In one embodiment, an electrically controllable coupling is provided in a drive rod connected to the lever arm. In this way, it is possible to stop unequivocally the lever arm even though it has just been moved, since all of the moving parts with greater mass are located before the coupling means.

It is particularly advantageous to provide that the coupling and/or the corresponding electrical activating mechanisms are so provided so that recoupling occurs after a full 360 degrees of rotation of the machine main shaft, measured from the decoupling point. This ensures that the lever arm commences to be driven at exactly the same point of the cycle at which the drive was interrupted. In this way, there is assurance that the fabric, in particular, warp knitted materials, do not contain optically visible errors caused by a power failure.

BRIEF DESCRIPTION OF THE DRAWINGS

The above brief description as well as other objects features and advantages of the present invention will be more fully appreciated by reference to the following detailed description of a presently preferred but nonetheless illustrative embodiment in accordance with the present invention when taken in conjunction with the accompanying drawings wherein:

FIG. 5 is a timing diagram associated with the arrangement of FIG. 1.

DETAILED DESCRIPTION OF THE PREFERRED EMBODIMENTS

Figure 1:
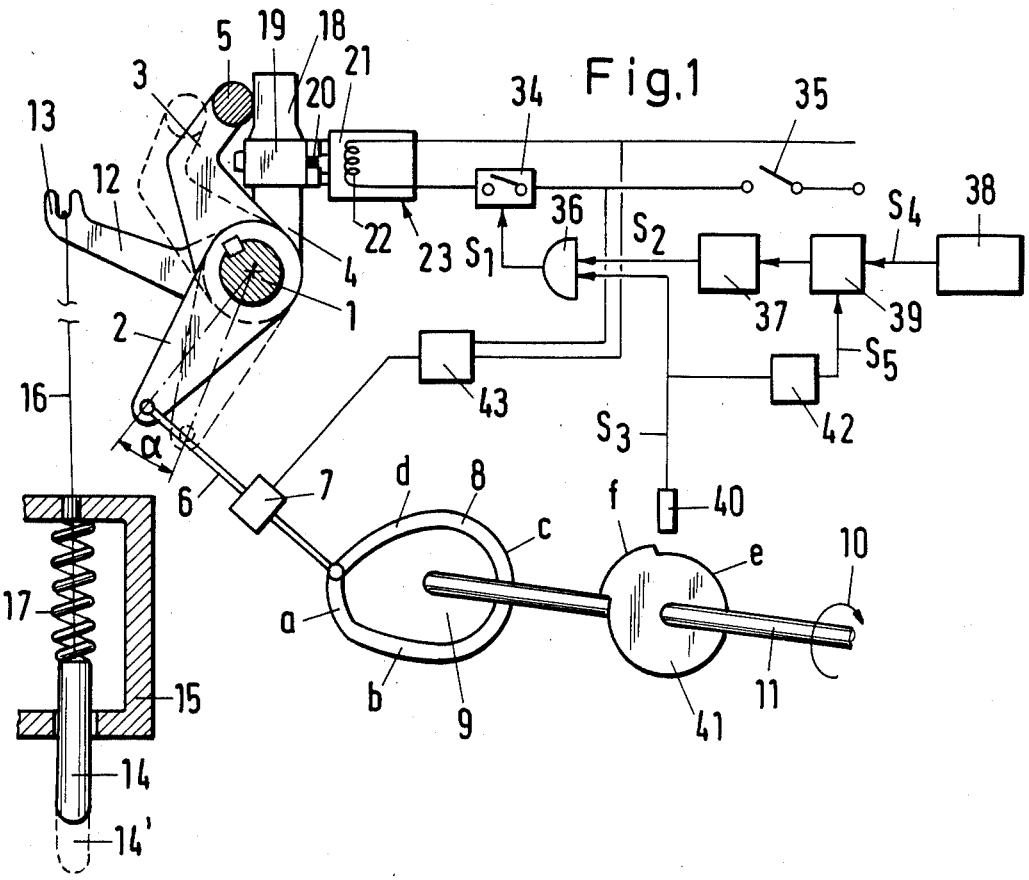
FIG. 1 is a schematic representation of a jacquard arrangement according to the principle of the present invention anchor in the contact position.
Figure 2:
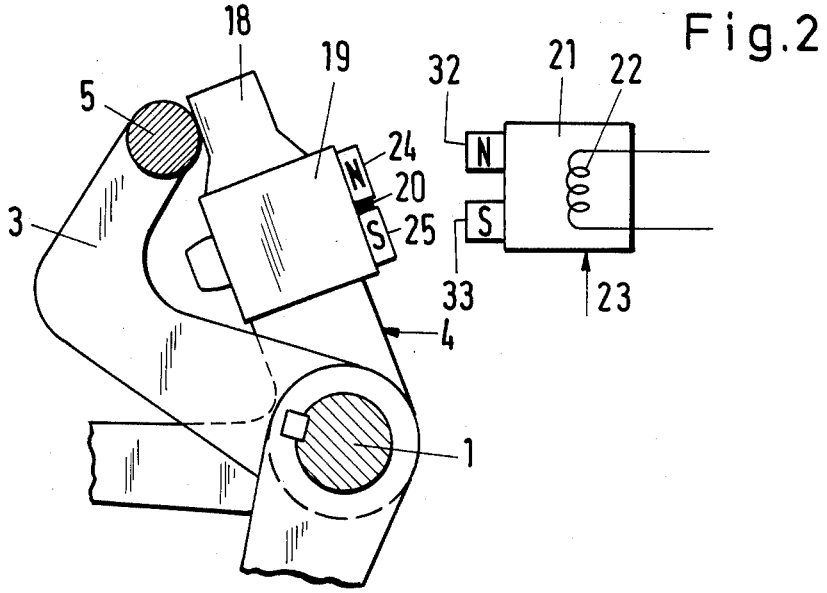
FIG. 2 is a partial representation of FIG. 1 showing the anchor in the free position.
Figure 3:
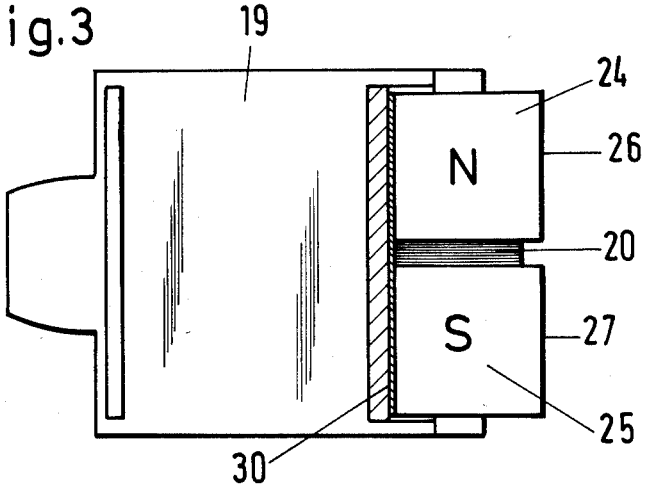
FIG. 3 is a partial, cross-sectional side view of the anchor of FIG. 2.

Referring to FIGS. 1 and 2, an electrically controlled jacquard arrangement has a common shaft 1. A setting means is shown herein as a synchronization means 2 and a lever arm 3 fixedly mounted on said shaft. The lever arm 3 has a contact rod 5 parallel to shaft 1. The lever arm 3 can be moved between the position actually shown in FIG. 1 and the returned position shown in FIG. 1 through an angle alpha by means of a push rod 6 into which an electrically activatable coupling 7 is provided. The push rod 6 is reciprocated by a cam track 8 on a cam plate 9 which is continually turned in the direction of arrow 10 by the machine main shaft 11 which can, for example, be the main shaft of a warp knitting machine. The cam track 8 comprises a constant displacement sector a, falling transition sector b, a longer second constant displacement sector c, and a rising transition sector d.

Coupling arm 4 is free to rotate on shaft 1, each coupling arm 4 comprises a lever arm 12 having a contact location 13 for a control element 14. Position 14' of control element 14, shown in phantom occurs when the coupling arm 4 is in the position indicated in FIG. 2.

In the present embodiment, the control element is illustrated as dropper bar 14 which is slidably held in the lower shelf of a double shelf peg bar 15. The top of bar 14 is connected to contact location 13 via harness cord 16. A compression spring 17, biasing control element 14 downward, serves to reduce the friction between the individual pairs.

On the other side, coupling arm 4 comprises a substantially radially directed coupling arm 18 on which an anchor 19 is provided. This anchor 19 is further provided with a permanent magnet 20 which interacts with electromagnet 23. Electromagnet 23 has a magnetic core 21 upon which repulsion winding 22 is wound. The anchor itself is made out of a non-magnetizable material, suitably a synthetic material.

The permanent magnet 20 is wafer-shaped and comprises sintered ferite. Such permanent magnets are produced by Firma Vakuumschmelze, Federal Republic of Germany, under the trademark "Vacomax 145". The permanent magnet is located between two wrought iron blocks 24 and 25, having anchor pole surfaces 26 and 27. Channels 28 and 29 are cut in said surfaces to reduce adhesion. The advantage of providing the pole surfaces 26 and 27 of the blocks 24 and 25 with grooves 28 and 29 are significant. The grooves 28 and 29 serve to reduce the pole surfaces of the anchor 19 which work together with the magnetic core 21 so that the adhesion between the anchor and the magnetic core, which can be disadvantageous during the start-up of the machine after a substantial stationary period, is reduced.

In this embodiment, the magnet 20 is so oriented that the upper wrought iron block is a north pole and the lower wrought iron block is a south pole.

It is advantageous from the point of view of assembly to form the strike surfaces 26 and 27 of the anchor 19 out of two blocks 24 and 25 of magnetic material and sandwich therebetween in contact with the mutually facing sides of these blocks, a disk formed permanent magnet 20. As a result of this construction the impact forces do not operate principally on the permanent magnet 20 but rather upon the metallic blocks 24 and 25. In this way, the impact strain upon the permanent magnet 20 is substantially reduced.

It is particularly desirable to make the blocks 24 and 25 out of wrought iron. This is advantageous not only for reasons of mechanical strength, but also because wrought iron increases the holding forces between the anchor 19 and the magnetic core 21 by a substantial factor.

It is also advantageous to provide that the pole surfaces 26 and 27 of the blocks 24 and 25 extend toward the cooperating surfaces of the magnetic core 21. Utilizing this mode of construction, even if the desired tolerances are not met during the actual machine assembly the pole surfaces 32 and 33 of the magnetic core 21 are thus enabled to always contact the corresponding blocks.

It is further advantageous that the blocks 24 and 25, on their side distal from the pull face are connected by a magnetic by-pass 30. As will be explained presently this serves to further reduce the repulsion time as well as the repulsion energy. On the side of the blocks 24 and 25, distal from the pole surfaces 26 and 27, there is provided a magnetic by-pass 30 of a plate of magnetizable material. The cross section of the by-pass is a small fraction of the cross section of the magnetizable blocks 24 and 25. For example, whereas the cross section of the blocks is about 12 millimeters, the by-pass cross section may be about 1.5 millimeters. Upon activation of the repulsion coil 22, the anchor 19 separates from core 21 to provide an air gap therebetween. The air gap has a far higher magnetic resistance than the by-pass so that the lines of force travelling through the by-pass are immediately strengthened. This brings about a reduction in the repulsion time and in the needed repulsion energy.

One must however take care that the repulsion current always exceeds a predetermined amount, at which level the attracting force of the anchor with permanent magnet is no longer sufficient to hold the anchor 19 to the magnet core 20. However, if the repulsion current rises above this minimum value, the repulsion force between the electromagnet core 21 and the permanent magnet 20 are greater which does not destroy the repulsion function. The repulsion current can vary within a rather substantial zone without bringing about maladjustments.

Figure 4:
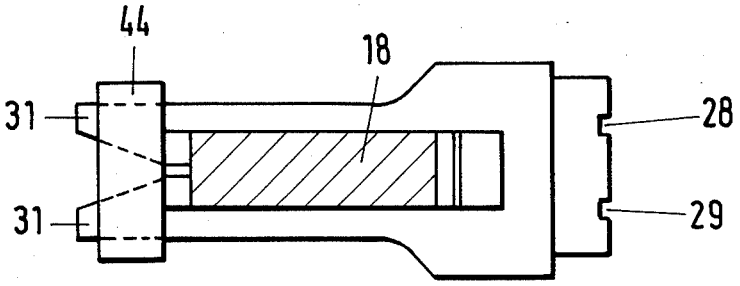
FIG. 4 is a partial plan cross-sectional view of the anchor viewed along line 4—4 of FIG. 3.
Figure 4:
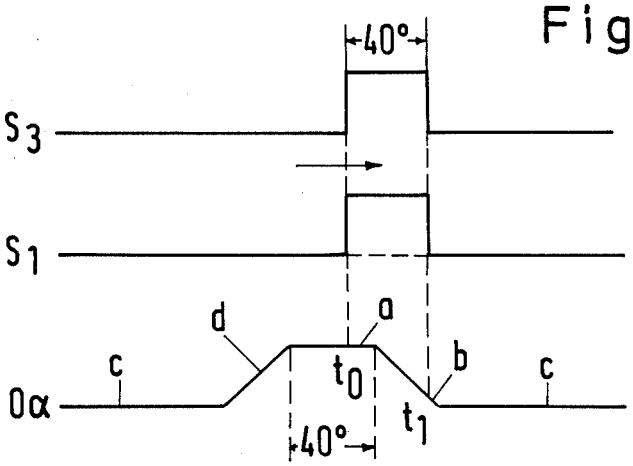

Referring to FIG. 4, anchor 19 is clipped onto coupling arm 18 by opening the spring like extensions 31 and securing said extension 31 to each other by securing ring 44. In a similar manner, magnetic core 21 (FIG. 2) comprises two pole surfaces, 32 and 33, which upon commencement of the activation energy in the repulsion coil 22, become north pole N and south pole S. When the anchor 19 has been brought into the position shown in FIG. 1 by means of lever arm 3, the permanent magnet 20 adheres to the magnet core 21 even when the lever arm 3 commences to return. When however, the repulsion coil 22 is activated in this setting, the poles of the magnetic core 21 and the anchor 19 repel each other, so that the coupling arm 4 is shown in the position illustrated in FIG. 2.

A potential A can be applied to repulsion coil 22 can by means of a switch arrangement 34 when the main switch 35 is closed. Coil 22 and switches 34 and 35 are serially connected to potential A, the switching arrangement 34 is electronically operated and is converted into the conducting condition by means of activating signal S1. This is provided at the output of and gate 36 at one of whose inputs a switching signal is provided and at whose other input may be provided the cycle signal. The switching signal is provided to the output of latch 37 which may be driven by control signal S4 from the program device 38 over a loading arrangement 39 when gated by the corresponding loading signal S5. Devices 38, 39 and 42 correspond to components 30, 31 and 34 of U.S. Pat. No. 4,448,046. The program device 38 holds the signals for the pattern to be created by the jacquard control arrangement. In order to build the cycle signal, a proximity sensor 40 is provided which is influenced by a trigger disk 41 running on main shaft 11. No signal is generated over the major circumferential segment e while the cycle signal 3 is generated over the smaller circumferential signal f.

The falling transition of the cycle signal S3 is generated in switching member 42 and similarly after a small delay, the loading signal S5, usually in the form of a short impulse. In the bottom line of the time diagram of FIG. 5 is shown how the angle alpha of the lever arm 3 changes in accordance with the progress of the cycle. In the vicinity of segment a the lever arm 3 (driven by cam plate 9, rod 6 and arm 2) presses the several anchors 19 against the appropriate magnet core 21. The return movement of lever arm 3 follows in the area of segment b. As is shown in the example, the contact phase (path segment a) runs for forty degrees of the turn of machine main shaft 11. The cycle signal S3 generated by proximity sensor 41 has the form of an impulse which, in this example, has the same forty degree duration and whose initial time point to is displaced with respect to the beginning of phase a so that the end point t1 is formed in the area of the declining phase (segment b). The activation signal S1 has the same phase as the cycle signal S3 when the program device 38 determines that the pattern requires the repulsion of the anchor 19. In the other case the activation signal S1 is zero as is shown in phantom in the second line of FIG. 5. The displacement of the initial time point to has the advantage that the anchors 19 are already biased towards the magnet core 21 contact them before repulsion current can be applied. The rising repulsion current impulse of the declining phase (segment b) which rises with activation signal S1 overlaps with the movement of the lever arm 3.

In particular, it is possible to provide a repulsion switching arrangement which gives off pattern related current impulses of a duration of between 5 and 20%, in particular 10% of the cycle time. For example, it is sufficient to utilize an activation time of 40 degrees of the main shaft rotation.

It is ensured that the repelled anchors 19 are returned to their position in as shown in FIG. 2 by lever arm 3. In this way noise factors are reduced in process and the life of the device is improved. It is sufficient to utilize rather short current impulses so that the required current consumption is rather small. The repulsed anchor 19 is continuously supported by the lever arm 3 so that no clattering noises will occur.

Upon the occurrence of power failure or at the opening of the main switch 35 the anchors 19 stay in the same position because of the permanent magnets. Since they should not be further moved by the lever arm 3 from that position, current dependent coupling 7 is deactivated. Thus the appropriate activating arrangement 43 is also dependent on the main switch 35 and connected to potential A. Upon removal of the potential A coupling 7 is immediately deactivated and uncoupled. In this way the lever arm 3 becomes stationary even if the machine main shaft 11 continues to turn.

Thus, the drive on the lever arm 3 from the main shaft 11 of the machine is so times by electrically controllable coupling 7 as to decouple in the event of power failure. In this manner, the permanent magnets 20 operate as data loggers. When the current fails, anchors 19 maintain their given position since the lever arm 3 is made inoperable by the decoupling. In this way, it is possible to avoid a fault in the pattern. As an example of coupling 7 there may be used a tooth holding coupling such as is offered by the Lenze firm of Moenninghof or a similar device. The coupling 7 and the corresponding activation arrangements 43 are so provided that the coupling is only reactivated after an initial 360 degree rotation of the main shaft 11 (as measured from the decoupling point). Thus if the jacquard arrangement controls a warp knitting machine, a weaving machine or the like when this machine is put into operation again the pattern will continue in an absolutely uninterrupted manner.

It is thus possible to obtain a jacquard steering arrangement with data security, low energy consumption and high reliability in process. It is not even necessary to utilize return springs in order to overcome magnetic hysteresis. The remaining spring 17 is only needed to overcome friction between the individual parts of the arrangement.

The activation signal for the repulsion winding 22 can also be obtained in a different manner in dependence upon the control signal from the programming device 38. In particular this is possible when the programming device is a computer.

I claim:

1. In an electromagnetically activated jacquard steering arrangement for positioning a plurality of steerable elements, a magnetic system comprising:

a magnetic core;

an anchor, said magnetic core and said anchor being relatively reciprocatable with respect to each other;

a permanent magnet attached to the anchor;

a repulsion winding on the magnetic core; and a setting means coupled to one of said steerable elements, said setting means being operable after the magnetic core and the anchor are caused to approach each other, to position said steerable element into one of two working positions, in response to activation or deactivation of the repulsion winding, respectively.

2. In an electromagnetically activated jacquard steering arrangement according to claim 1, the magnetic core being stationary and the anchor, having the permanent magnet affixed thereto, being moveable.

3. In an electromagnetically activated jacquard steering arrangement according to claim 2, said magnetic system further comprising:

a coupling arm connected with said anchor for swinging it against the magnetic core; and a cyclically activated lever arm following a forward and return motion for driving said coupling arm and said anchor.

4. In an electromagnetically activated jacquard steering arrangement according to claim 1, said magnetic system further comprising:

a repulsion current switching arrangement for energizing said repulsion winding in response to movement of said lever arm, said switching arrangement being operable at least at the beginning of the return movement of the lever arm to provide overlapping current impulses to said repulsion winding.

5. In an electromagnetically activated jacquard steering arrangement in accordance with claim 4, said repulsion current switching arrangement providing said current impulses for a duration of 5% to 20% of the cycle time of the arrangement.

6. In an electromagnetically activated jacquard steering arrangement in accordance with claim 5, the duration of said current impulses being about 10% of said cycle time of said arrangement.

7. In an electromagnetically activated jacquard steering arrangement in accordance with claim 1, said magnetic system further comprising:

a pair of spaced blocks of magnetic material each having a pole surface; and a permanent wafer-shaped magnet positioned between said spaced blocks of magnetic material.

8. In an electromagnetically activated jacquard steering arrangement according to claim 7, the blocks being made of wrought iron.

9. In an electromagnetically activated jacquard steering arrangement according to claim 7, the permanent magnet being made of a ferrite sinter.

10. In an electromagnetically activated jacquard steering arrangement in accordance with claim 7, the pole surfaces of the blocks protruding outwardly towards the corresponding pole surfaces of the magnetic core.

11. In an electromagnetically activated jacquard steering arrangement in accordance with claim 7, the pole surfaces of the blocks each having formed therein a channel.

12. In an electromagnetically activated jacquard steering arrangement in accordance with claim 7, said magnetic system further comprising:

a magnetic bypass bridging the blocks on the side distal to the pole surfaces.

13. In an electromagnetically activated jacquard steering arrangement in accordance with claim 1, said jacquard steering arrangement having a machine main shaft, said magnetic system further comprising:

an electrically activatable coupling coupled between said lever arm and said machine main shaft, said coupling being arranged to causes disconnection upon power failure.

14. In an electromagnetically activated jacquard steering arrangement in accordance with claim 13, said magnetic system further comprising:

a drive rod coupled between the coupling and the lever arm.

15. In an electromagnetically activated jacquard steering arrangement in accordance with claim 13, the coupling being operable after restoration of power thereto to recouple said lever arm and said machine main shaft, after a single rotation of 360′ of the main shaft.

16. A method employing a jacquard steering arrangement for positioning at least one steerable element with a magnetic core having a repulsion winding, and a permanent magnet attached to an anchor, comprising the steps of:

periodically urging said magnetic core and said anchor towards each other , said anchor being linked to said steerable element; and causing repulsion or attraction between said core and anchor after they are caused to approach each other by activating or deactivating, respectively, the repulsion winding, to position said steerable element into one of two working positions.

17. A method according to claim 16 further comprising the step of:

energizing said repulsion winding while said anchor and core are together.

18. A method in accordance with claim 17 wherein said repulsion winding is energized for a duration in the range of 5% to 20% of the cycle time of the arrangement.

19. A method in accordance with claim 16, further comprising the step of:

ceasing the urging together of said core and anchor upon power failure in said jacquard steering arrangement.

20. A method in accordance with claim 19 wherein said jacquard steering arrangement has a machine cycle, said method further comprising the step of:

delaying the restarting of the urging together of said anchor and core at least until the completion of said machine cycle.

* * * * *